US005442819A

United States Patent [19]

Penor et al.

[11] Patent Number: 5,442,819

[45] Date of Patent: Aug. 22, 1995

[54] ARTICLE CATCHER FOR SINK DRAIN

[76] Inventors: Ernie R. Penor; Amelita P. Penor, both of 4205 Peasley Canyon Rd., Auburn, Wash. 98001

[21] Appl. No.: 247,870

[22] Filed: May 23, 1994

[51] Int. Cl.[6] ..... E03C 1/26

[52] U.S. Cl. ..... 4/288

[58] Field of Search ..... 4/286–292

[56] References Cited

U.S. PATENT DOCUMENTS

| | | | |
|---|---|---|---|
| 526,637 | 9/1894 | Ryan | 4/291 |
| 596,763 | 1/1898 | Stretch | 4/291 |
| 938,607 | 11/1909 | Reed | 4/291 |
| 960,901 | 6/1910 | Hall | 4/289 |
| 1,083,990 | 1/1914 | Collins | 4/289 |
| 2,548,541 | 9/1951 | MacDonald | 4/292 X |
| 4,045,351 | 8/1977 | Peterson | 4/292 X |

FOREIGN PATENT DOCUMENTS

| | | | |
|---|---|---|---|
| 0001944 | of 1905 | United Kingdom | 4/291 |

*Primary Examiner*—Charles E. Phillips
*Attorney, Agent, or Firm*—Delbert J. Barnard

[57] ABSTRACT

A tubular inlet portion (12) is connected to a sink drain outlet member. A tubular outlet portion (14) fits into and is connected to a drain pipe member that is a part of a standard drain system for a sink. An article falling through the sink drain opening will enter a housing (22, 24, 26) which includes a catcher wall (32). The article will first contact a conical center portion (36) of the catcher wall (32) and will then slide down onto an annular radial wall portion (34) of the catcher wall (32). Water entering the drain will pass through openings (38) and slots (40). The housing (22, 24, 26) has a clear plastic sidewall (24) through which the catcher wall (32) and any article on it can be viewed.

4 Claims, 2 Drawing Sheets

ARTICLE CATCHER FOR SINK DRAIN

TECHNICAL FIELD

This invention relates to an article catcher that is connectable into a drainpipe system for a sink, between a sink drain outlet member and a drainpipe member.

BACKGROUND INFORMATION

Sinks are provided with a drain system which includes a sink drain outlet member and drainpipes which include a trap. A principal object of this invention is to provide an article catcher which is connectable in such a system between the sink drain outlet member and a drainpipe member below it that is a part of the drain system. The main purpose of the article catcher is to collect and recover any valuable personal belongings or other useful articles that may find their way into the sink drain system. Another object of the invention is to provide an article catcher composed of an upper end tubular inlet portion, a lower end tubular outlet portion and a catcher portion interconnected between said upper end tubular inlet portion and said lower end tubular outlet portion.

DISCLOSURE OF THE INVENTION

The article catcher of the present invention is basically characterized by an upper end tubular inlet portion that is connectable to a sink drain outlet member and a lower end tubular outlet portion that is connectable to a drainpipe member. A catcher portion is interconnected between the upper end tubular inlet portion and the lower end tubular outlet portion.

The catcher portion comprises a housing including an annular top wall having a small diameter inner edge, which defines a central opening, and a large diameter outer edge. The upper end tubular inlet portion is connected to the annular top wall generally at the small diameter inner edge. The upper end tubular inlet portion extends upwardly from the annular top wall. According to the invention, the housing also includes a cylindrical upper sidewall having an upper end that is connected to the outer edge of the annular top wall and a lower end that is spaced axially below the upper end. It further includes a converging lower sidewall having an upper end that is connected to the lower end of the cylindrical upper sidewall, and a lower end that is connected to the lower end tubular outlet portion. The lower end tubular outlet portion extends axially downwardly from the lower end of the converging lower sidewall.

According to the invention, a catcher wall is located within the housing. The catcher wall includes an annular radial wall portion having an outer edge that is connected to the catcher housing portion and an inner edge. The catcher wall also includes a conical wall portion having a base end that is connected to the inner edge of the annular radial wall portion. The conical wall portion extends upwardly from the annular radial wall portion to an upper end apex. The upper end apex is positioned below the central opening in the annular top wall.

According to the invention, the annular radial wall portion of the catcher wall includes a plurality of circumferentially spaced, radially elongated openings for passing drain water. The conical portion of the catcher wall includes a plurality of additional openings for passing drain water. According to the invention, the cylindrical sidewall of the housing is made from a clear material so that a person can look into the housing an see any article that may have fallen through the sink drain outlet member onto the catcher wall.

In preferred form, the upper end tubular inlet portion includes an upper end portion having external threads. Also, the lower end tubular portion is a right circular cylinder.

BEST MODE FOR CARRYING OUT THE INVENTION

Figure 2:
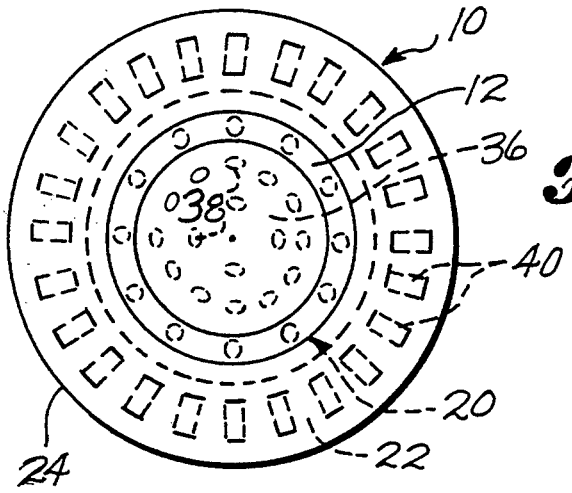
FIG. 2 is a top plan view of FIGS. 1 and 3.
Figure 1:
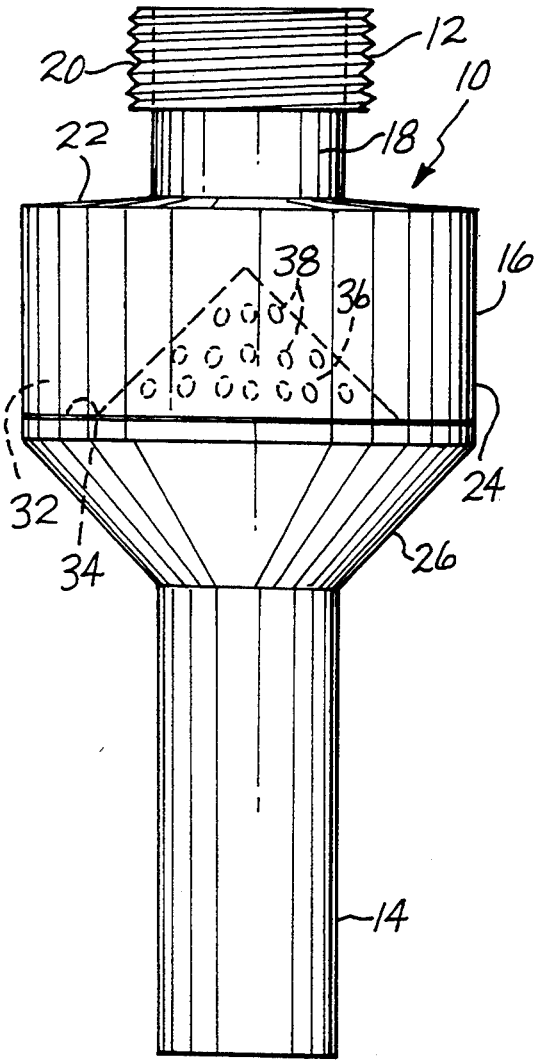
FIG. 1 is a side elevation of an article catcher constructed in accordance with the present invention.
Figure 3:
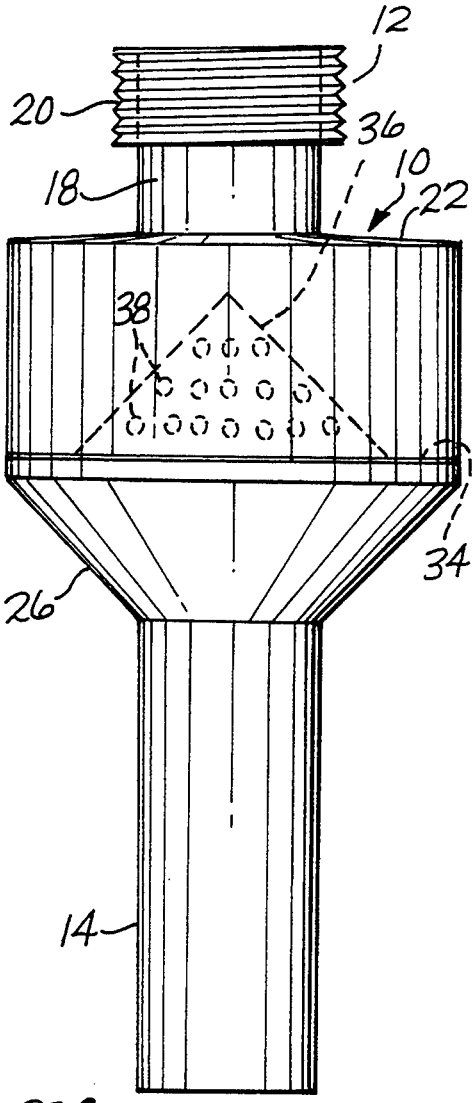
FIG. 3 is a front elevational view of the article catcher shown by FIGS. 1 and 2.

Referring to FIGS. 1–4, the article catcher 10 is composed of an upper end tubular inlet portion 12, a lower end tubular outlet portion 14 and a catcher portion 16 that is interconnected between the upper end portion 12 and the lower end portion 14. Catcher portions 12, 14, 16 share a common vertical axis.

The upper end portion 12 has a tubular neck 18 and an externally threaded head 20. The lower end portion 14 is a right cylinder. The catcher portion 16 has an annular top wall 22, a cylindrical upper sidewall 24 and a converging lower sidewall 26, together defining a housing. The top wall 22 has a small diameter inner edge 28 (FIG. 4) and a large diameter outer edge 30. The inner edge 28 defines a central opening. Neck portion 18 of inlet portion 12 is connected to annular wall portion 22 at the inner edge 28, immediately around the center opening. A catcher wall 32 is located within the housing 22, 24, 26. Catcher wall 32 includes an annular radial wall portion 34 that surrounds a conical center portion 36.

In preferred form, the head is made from PVC plastic. It is one and one-fourth inches ($1\frac{1}{4}''$) long and has a one and one-fourth inch ($1\frac{1}{4}''$) diameter. The threads are standard Mayo National Pipe thread. This pipe thread fits the adapter of a standard one and one-fourth inch ($1\frac{1}{4}''$) sink drain outlet member.

Figure 4:
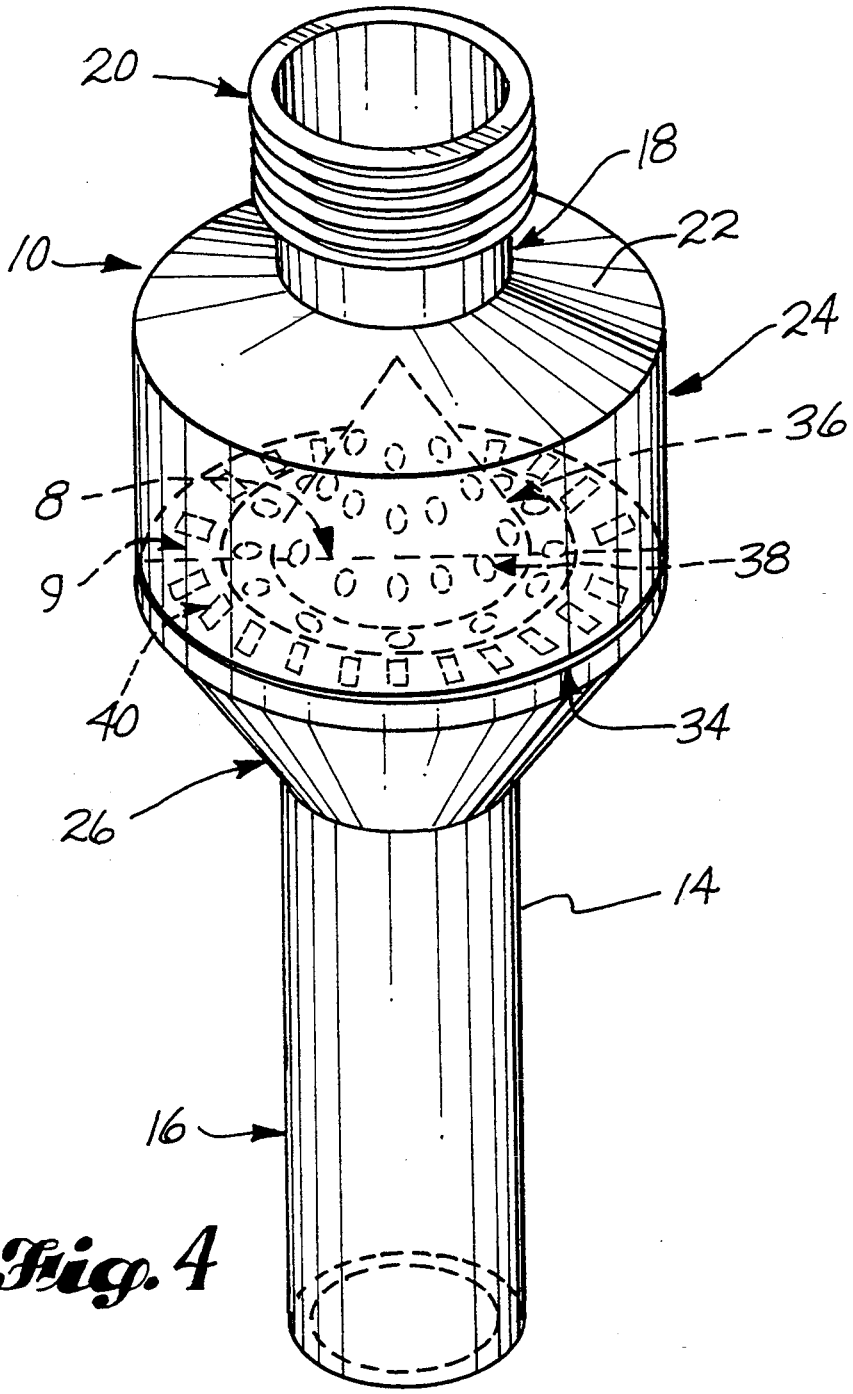
FIG. 4 is a pictorial view of the article catcher shown by FIGS. 1–3.

The cylindrical portion of the catcher housing is one and one-half inches ($1\frac{1}{2}''$) high and has a three inch (3″) outside diameter. The cylindrical sidewall is made of clear plastic. The conical center portion 46 of the catcher wall 36 has a minimum of twenty-eight evenly distributed openings, some of which are designated 38. These openings measure one eighth of an inch ($\frac{1}{8}''$) in diameter. The conical center portion 36 is one inch (1″) high and has a two inch (2″) base diameter. The annular radial wall portion 34 has a radial dimension or width of one-half inch ($\frac{1}{2}''$). As illustrated, this portion 34 is interconnected between the base of conical center portion 36 and the cylindrical sidewall portion 24. Wall portion 34 includes a minimum of twenty-four (24) slots 40 (FIG. 4). The slots are one eighth of an inch ($\frac{1}{8}''$) wide and one fourth of an inch ($\frac{1}{4}''$) long. The minimum thickness of portions 34, 36 is one sixteenth of an inch (1/16″). Wall portion 34 and the base of conical center portion 36 are elevated one fourth of an inch ($\frac{1}{4}''$) above the bottom of the cylindrical sidewall 24.

The lower end portion 14 may also be termed "the tail section 14." It is made of PVC plastic and has a minimum thickness of one sixteenth of an inch (1/16"). The converging or conical sidewall 26 and the pipe section 14 together have a length of four inches (4"). Pipe 14 is three inches (3") long. The taper of wall 26 is forty-five degrees (45° ) and the height of wall 26 is one inch (1"). The outside diameter of pipe 14 is one and one fourth of an inch (1¼").

The making of cylindrical wall 24 from clear plastic provides for easy viewing and inspection of the catcher wall 32 and any article that is located on it. The hose 38 and slots 40 provide for easy passage and flow of water through the catcher wall 32. An article falling into the housing will strike the cone portion 36 and slide down it, as clearly evident from FIGS. 1, 3 and 4. The pipe 14 is insertible into any standard one and one-fourth inch (1¼") or one and one-half inch (1½") P trap.

It is an object of the present invention to provide a multipurpose article catcher or strainer that is simple, lightweight and rigid in construction and which is easy to connect and disconnect to any existing sink drain system.

We claim:

1. For use in a drainpipe system for a sink, an article catcher comprising:

an upper end tubular inlet portion connectable to a sink drain outlet member;

a lower end tubular outlet portion connectable to a drain pipe member; and a catcher portion interconnected between said upper end tubular inlet portion and said lower end tubular outlet portion;

said catcher portion comprising a housing including an annular top wall having a small diameter inner edge defining a central opening and a large diameter outer edge;

said upper end tubular inlet portion being connected to said annular top wall generally at said small diameter inner edge, and extending upwardly from said annular top wall;

said housing also including a cylindrical upper sidewall having an upper end connected to the outer edge of the annular top wall and a lower end spaced axially below the upper end, and a converging lower sidewall having an upper end connected to the lower end of the cylindrical upper sidewall, and a lower end connected to the lower end tubular outlet portion;

said lower end tubular outlet portion extending axially downwardly from the lower end of said converging lower sidewall;

a catcher wall within said housing, said catcher wall including an annular radial wall portion having an outer edge connected to said catcher housing portion and an inner edge, and a conical wall portion having a base end connected to the inner edge of said annular radial wall portion, said conical wall portion extending upwardly from said annular radial wall portion to an upper end apex that is positioned below the central opening in the annular top wall;

said annular radial wall portion of the catcher wall including a plurality of circumferentially spaced, radially elongated openings for passing drain water;

said conical portion of the catcher wall including a plurality of additional openings for passing drain water; and said cylindrical sidewall being made from a clear material so that a person can look into the housing and see any article that may have fallen through the sink drain outlet member onto the catcher wall.

2. An article catcher according to claim 1, wherein the upper end tubular inlet portion includes an upper end portion having external threads.

3. An article catcher according to claim 1, wherein the lower end tubular outlet portion is a right circular cylinder.

4. An article catcher according to claim 3, wherein the upper end tubular inlet portion includes an upper end portion having external threads.

* * * * *